US006517929B1

(12) United States Patent
Shibatani et al.

(10) Patent No.: US 6,517,929 B1
(45) Date of Patent: Feb. 11, 2003

(54) RECORDING MEDIUM, MANUFACTURING METHOD THEREOF AND RECORDING METHOD AND RECORDED MATTER USING THE SAME

(75) Inventors: Masaya Shibatani, Nagano (JP); Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/724,498

(22) Filed: Nov. 28, 2000

(30) Foreign Application Priority Data

Nov. 29, 1999 (JP) ..... 11-337321
May 15, 2000 (JP) ..... 2000-141405

(51) Int. Cl.[7] ..... B41M 5/00
(52) U.S. Cl. ..... 428/195; 427/152
(58) Field of Search ..... 428/195; 427/152

(56) References Cited

FOREIGN PATENT DOCUMENTS

| | | | |
|---|---|---|---|
| EP | 0889080 | | 11/1999 |
| JP | 04007189 | | 1/1992 |
| JP | 406017399 | A * | 1/1994 |
| JP | 06032046 | | 2/1994 |
| JP | 08300805 | | 11/1996 |
| JP | 08300806 | | 11/1996 |
| JP | 08332722 | | 12/1996 |
| JP | 10244748 | | 9/1998 |
| JP | 11091240 | | 4/1999 |
| WO | 9957215 | | 11/1999 |

OTHER PUBLICATIONS

Patent Abstracts of Japan Publication No. 04007189 dated Jan. 10, 1992.
Patent Abstracts of Japan Publication No. 06032046 dated Feb. 8, 1994.
Patent Abstracts of Japan Publication No. 08300805 dated Nov. 19, 1996.
Patent Abstracts of Japan Publication No. 08300806 dated Nov. 19, 1996.
Patent Abstracts of Japan Publication No. 08332722 dated Dec. 17, 1996.
Patent Abstracts of Japan Publication No. 11091240 dated Apr. 6, 1999.

* cited by examiner

*Primary Examiner*—Bruce H. Hess
(74) *Attorney, Agent, or Firm*—Ladas & Parry

(57) ABSTRACT

To provide a recording medium enabling outstanding light-fastness of images, outstanding glossiness, surface damage resistance and conveyance of the recording medium, as well as improved waterfastness and the printing density of images and improved ink absorption of the recording medium.

A recording medium configured of a substrate, an ink accepting layer provided on the substrate, and a glossy layer serving as a surface layer, provided on the ink accepting layer, wherein the glossy layer is hardened by a zirconium compound and a resin capable of reacting with the zirconium compound and forming a crosslinking structure.

13 Claims, 3 Drawing Sheets

RECORDING MEDIUM, MANUFACTURING METHOD THEREOF AND RECORDING METHOD AND RECORDED MATTER USING THE SAME

BACKGROUND OF THE INVENTION

1. Field of the Invention

The present invention relates to a recording medium comprising an ink accepting layer and a glossy layer serving as a surface layer provided on a substrate, wherein such glossy layer is hardened by means of a zirconium compound and a resin capable of reacting with the zirconium compound and forming a crosslinking structure. More particularly, the present invention relates to a recording medium including a hardened glossy layer serving as a surface layer, accomplishing outstanding lightfastness of images, outstanding surface damage resistance and conveyance of the recording medium, improved waterfastness and printing density (color property) of images, and improved glossiness and ink absorbing property of the recording medium. The present invention also relates to a manufacturing method of such recording medium, as well as a recording method using such recording medium and a recorded matter having ink images recorded using such recording medium.

2. Description of Related Art

Plain paper, a recording medium having a glossy surface on the recording side, or coating paper having an ink accepting layer on the recording side (surface side) are known as a recording medium for forming and recording images including letters. In recent years, these recording mediums are required to enable production of clear color images having higher resolution, and to preserve the favorable quality of images and thereby provide clear images over a long period of time. For the long-term preservation of clear images with high resolution, such images must exhibit high lightfastness even if exposed to light for a long period of time.

Furthermore, the recent development in technology has enabled the production of high picture quality images comparable to silver halide photography. Therefore, recording mediums are required to have the same level of glossiness as silver halide photography. There has been a problem, however, in that when images are recorded (printed) on a glossy recording medium, notched roller traces are left by the conveying mechanism of a printer.

With the purpose of providing an inkjet recording paper exhibiting high lightfastness and other favorable properties for preserving the quality of printed images, Patent Laid-Open Publication No HEI 6-32046 suggests an aqueous inkjet recording paper wherein at least one side of a base material is provided with an ink accepting coating layer 2 to 20 g/m$^2$, mainly consisting of: (a) amorphous fine powder silica 60 to 90 percents by weight (of the total solid content of the paint); (b) vinyl alcohol copolymer including silanol group 5 to 30 percents by weight; and (c) a zirconium compound 0.1 to 10 percents by weight.

However, this recording paper exhibits insufficient lightfastness, remaining at almost the same level as that of conventional recording papers. Furthermore, this recording paper is a non-glossy type.

Similarly, with the purpose of providing an inkjet recording medium exhibiting favorable ink acceptance upon recording, high recording picture quality, and high preservation after recording, suitably used upon recording with aqueous ink, Patent Laid-Open Publication No. HEI 4-7189 suggests an inkjet recording medium comprising a special ink accepting layer on a substrate, which is fabricated by adding oxychloride zirconium inorganic polymer to the coating liquid for forming the ink accepting layer. However, this recording medium is also a non-glossy type and fails to fulfill the above requirement.

Moreover, in order accomplish high resolution, a device for recording images on a recording medium must be able to firmly press down a recording medium and perform a highly accurate conveyance. Therefore, a device having a notched roller (thin-plate star wheel) is generally used as a recording device. If images are recorded onto recording mediums using such recording device, notched rollers are pressed against the recording surface on which images are to be produced, whereby linear and dot traces ("notched roller traces") of the rollers are left on the recording surface. Especially, in the case of recording mediums having a glossy surface or recording mediums such as coating paper, the notched roller traces are left on the surface of a recording medium in a conspicuous manner and the quality of the high resolution images is thereby impaired. In order to solve this problem, various technologies are proposed for making the surface damage of the recording medium less conspicuous and thereby enhancing the quality of images (Patent Laid-open Publications No. HEI 8-300805, No. HEI 8-300806, 8-332722, No. HEI 11-91240, etc.)

However, in the case of these recording mediums and recording methods, the surface damage of the recording medium is still conspicuous and there remains a problem in the quality of images. Moreover, use of conventional recording mediums causes the generation of paper powder or the falling of powder from the surface of the recording medium when paper is fed by a printer for printing, or the feeding of paper in several layers or the complete failure in feeding paper. Thus, conventional recording mediums have a problem in terms of conveyance.

As explained above, a recording medium is required to exhibit outstanding properties in terms of lightfastness, glossiness, surface damage resistance, conveyance, waterfastness of images, printing density, ink absorption, etc. None of the conventional recording mediums have fulfilled all of these requirements.

SUMMARY OF THE INVENTION

Therefore, the object of the present invention is to solve the problems above and to provide a recording medium accomplishing outstanding lightfastness of images, outstanding gloss surface, surface damage resistance and conveyance of the recording medium, as well as improved waterfastness and printing density of images, and improved ink absorption of the recording medium.

In order to accomplish the aforementioned object, the present invention provides a recording medium for inkjet/bubblejet printers or the like, comprising on a substrate an ink accepting layer and a glossy layer serving as a surface layer. The glossy layer serving as a surface layer is hardened by its components, i.e., a zirconium compound and a resin capable of reacting with the zirconium compound and forming a crosslinking structure. The recording medium thereby exhibits outstanding lightfastness, glossiness, surface damage resistance and conveyance, as well as improved waterfastness, ink absorption, and image printing density.

The glossy layer serving as a surface layer, which is hardened by a zirconium compound and a resin capable of reacting with the zirconium compound and forming a crosslinking structure, particularly enhances the lightfastness of images and resists to the notched rollers pressed against the surface layer, such that the recording medium exhibits higher surface damage resistance and prevents traces on the surface layer. Furthermore, the hardened glossy layer serving as the surface layer has an increased surface intensity and prevents the generation of paper powder or the falling of powder when the recording medium is conveyed by a printer, and the conveyance of the recording medium is thus enhanced.

In conventional recording mediums, the higher the glossiness, the more conspicuous the surface damage (notched roller traces) caused by notched rollers or the like. Whereas, the recording medium according to the present invention has high glossiness, and yet the surface damage caused by notched rollers or the like is dramatically reduced.

DESCRIPTION OF PREFERRED EMBODIMENTS

Figure 1:
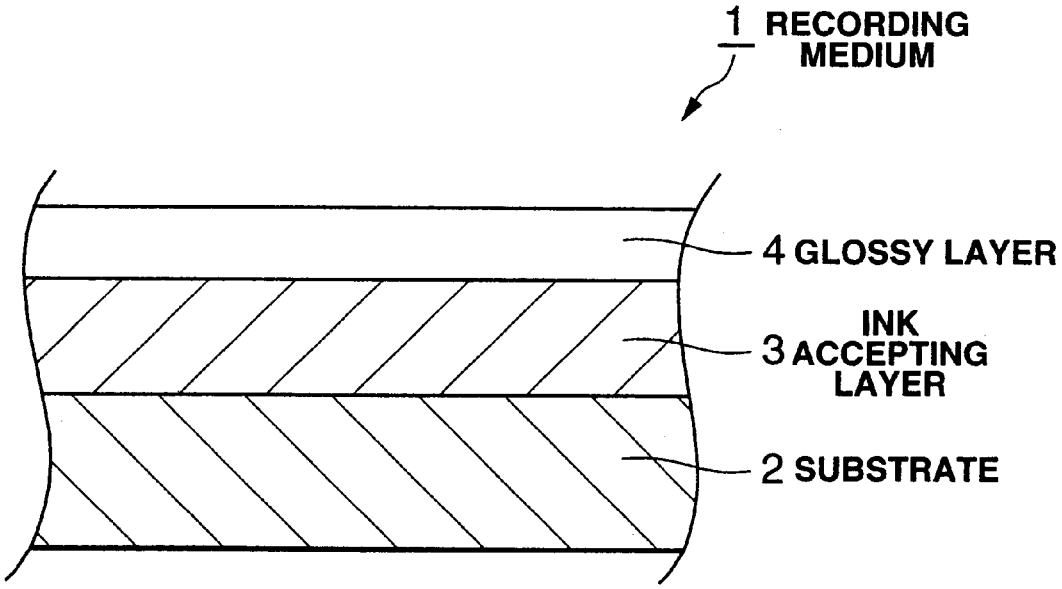
FIG. 1 is a cross section of an embodiment of the recording medium according to the present invention.

Now, the recording medium of the present invention is explained in detail according to its preferred embodiment. FIG. 1 shows a cross section of a preferred embodiment of the recording medium according to the present invention.

As shown in FIG. 1, the recording medium 1 according to the embodiment is configured by: a substrate 2; a porous ink accepting layer 3 for absorbing and fixing the ink, provided on the substrate 2; and a glossy layer 4 serving as a surface layer, provided on the ink accepting layer 3. The surface layer is the outermost layer located on the side of the recording medium designed for forming and recording letters and other images.

The glossy layer 4 serving as a surface layer absorbs ink and enables the penetration of ink to the underlying ink accepting layer 3.

The glossy layer 4 serving as a surface layer is hardened by means of a zirconium compound and a resin capable of reacting with the zirconium compound and forming a crosslinking structure.

Examples of the zirconium compound above include: acetylacetone zirconium complexes, zirconium basic carbonate, zirconium basic sulfate, zirconium oxychloride, zirconium acetate, zirconium nitrate, zirconium hydroxide, ammonium zirconium carbonate (AZC), potassium zirconium carbonate, zirconium hydroxychloride, zirconium propionate, zirconium sulfate, zirconium phosphate, zirconium sodium phosphate, zirconium hexafluoride, etc. Commercial products, such as "Zircosol AC-7 (product manufactured by Daiichi Kigensokagaku Kogyo Co., Ltd.) and "Bacote 20" (registered trademark; product manufactured by Nipponkeikinzoku Co., Ltd.) can be used.

Of the zirconium compounds above, zirconium carbonate salt is especially preferable (inter alia "Zircosol AC-7" and "Bacote 20") in that it enhances the lightfastness of images and also makes the surface damage of the recording medium inconspicuous, thereby improving the quality of images.

The aforementioned zirconium compound may be used without any specific limitation to its form. For example, the zirconium compound can be used in a form of paste, solution, powder or the like, and may have a neutral, positive, or negative ionic property. However, as in the case of "Zircosol AC-7" and "Bacote 20" above, a zirconium compound in the form of a solution and having a neutral ionic property is especially preferable.

Furthermore, the glossy layer 4 serving as the surface layer is formed of a resin capable of reacting with the zirconium compound and forming a crosslinking structure. Such resin can be a resin containing a functional group, such as a carboxyl group, amide group, hydroxyl group, or methylol group. For example, acrylic resin, styrene-butadiene rubber (SBR), polyvinyl alcohol (PVA), carboxyl methyl cellulose (CMC), modified starch, casein, etc. can be used of these resins, a resin containing a hydroxyl group, especially polyvinyl alcohol, is preferred for further enhancing the liqhtfastness of images and the surface damage resistance of the recording medium.

Moreover, polyvinyl alcohol having a saponification rate of 80 or more, especially 88 or more, is preferably used as the polyvinyl alcohol above. "Saponification rate" is expressed with a "(mol)%" unit, and indicates the level of progress in the saponification reaction taking place in the course of the production of polyvinyl alcohol, whereby an acetyl group (—$OCOCH_3$) contained in a polyvinyl acetate molecule is changed to a hydroxyl group (—OH).

Furthermore, examples of the acrylic resin include: polyacrylic acid derivatives, such as polyacrylic acid, polyacrylic ester, polyacrylic amide, or compounds introducing several substitutional groups to polyacrylic acid or derivatives thereof; or copolymers of acrylic acid monomer or acrylic acid derivative monomer (e.g., acrylic ester monomer, acrylic amide monomer) forming the polyacrylic acid or the derivatives thereof with other monomers capable of copolymerizing therewith. Specific examples of such acrylic resins include; polyacrylic acid ester, such as polydimethylaminoethyl acrylate, polydimethyl aminoethyl methacrylate, poly2-hydroxyethyl methacrylate, and poly2-hydroxyethyl acrylate.

The surface layer is hardened by a firmly binding crosslinking structure, such as C—O—Zn—O—C, formed as a result of functional groups of the resins above reacting with zirconyl ion of the zirconium compounds above. Furthermore, these resins also function as binders.

The amount of the zirconium compound used may be suitably determined according to the type of the zirconium compound or the degree of crosslinking. However, in order to enhance the effect of the present invention, the zirconium compound amount contained in the surface layer of 100 parts by weight is preferably 1.0 to 10 parts by weight, more preferably 1.5 to 4.0 parts by weight.

Similarly, the amount of the resin used for forming the aforementioned crosslinkinq structure is preferably 20 to 60 parts by weight, more preferably 30 to 50 parts by weight within the surface layer of 100 parts by weight.

Furthermore, the ratio (weight ratio) of the zirconium compound to the resin capable of forming a crosslinking structure is preferably 1/60 to 1/2, more preferably 1/40 to 1/20.

Moreover, other than the zirconium compound and the resin specified above, highly-transparent fine pigments, such as colloidal silica, silica gel produced by a gas phase method, or alumina sol (preferably with boehmite-like structure), are included in the glossy layer 4 serving as a surface layer, so that a high picture quality of the recording medium and improved printing density and saturation of images are obtained. Furthermore, the glossy layer 4 may include singlet oxygen quenchers, HALS (hindered amine type light stabilizers), anti-oxidants, UV absorbers, fluorescent brightening agents, waterfastness enhancing agents, anti-fading agents, anti-static agents, etc.

The glossy layer 4 serving as a surface layer may be formed by applying to the ink accepting layer 3 a coating liquid prepared by dissolving or dispersing in water or an adequate solvent the aforementioned composition for forming the glossy layer 4 by a coating method selected from cast coating, transcription coating, photogravure coating methods, or the like. A calender processing by machine calender, TG calender, super calender, soft calender, or the like may be performed for increasing the smoothness of the glossy layer 4. The coating liquid is preferably applied in an amount (calculated solid content) of 5 to 15 g/m$^2$, more preferably 8 to 10 g/m$^2$. Application of the coating liquid less than 5 g/m$^2$ will reduce the surface glossiness of the recording medium and may also reduce the high picture quality. On the other hand, application of the coating liquid more than 15 g/m$^2$ is not preferred because the production costs will be increased and yet higher performance may not be expected.

Upon application, the coating liquid is preferably heated to a temperature of, for example, 100 to 150° C. (especially preferable if 120 to 140° C.) in order to facilitate the formation of the crosslinking structure in the surface layer.

Furthermore, the coating liquid is preferably applied by a cast coating, transcription coating or photogravure coating method because the formation of the crosslinking structure in the surface layer is thereby facilitated and the surface layer has favorable smoothness, It is especially preferable that the surface layer is formed by a cast coating or transcription coating method so that the properties above are even more enhanced.

"Transcription coating method" here means a method of forming a surface layer by applying with a bar coater a desired amount of a glossy layer coating liquid onto a substrate made of polyolefine film, tetrafluoride ethylene film, peel-away silicon processed resin film, or the like, i.e., a material uneasily attaching to the coating liquid for forming the surface layer, then placing onto the ink accepting layer the side of the ink accepting layer coated with the coating liquid, drying the layers for a desired period of time at a desired temperature, and finally peeling away the substrate.

The obtained glossy layer 4 serving as a surface layer has been thus hardened, and demonstrates high lightfastness, glossiness and coated film property. Furthermore, because the hardened glossy layer 4 has an increased surface intensity, the conveyance of the recording medium is enhanced. And yet, the glossy layer 4 serving as the surface layer does not hinder the permeation or absorption of ink to the underlying ink accepting layer 3, and exhibits outstanding dryness, fixability, waterfastness, and other favorable properties which are commonly required of a glossy layer.

It is preferred that the glossy layer 4 serving as a surface layer has a 60-degree mirror surface (defined by JIS Z8741) of 20% or more, especially 30% or more, because a photo-like recording medium having high glossiness is thereby obtained, and images printed using such recording medium will also have high resolution.

In the recording medium according to the present embodiment, base paper is used as the substrate 2. Pulp materials mainly made of, for example, natural cellulose are preferred for forming the base paper. Examples of such pulp materials include NBKP, LBKP, NBSP, LBSP, GP, TMP, used paper, etc. More than one of these materials can be used, mixing the materials at a suitable rate depending on the purpose of use. Furthermore, non-tree paper materials mainly made of bagasse, kenaf, manila hemp, esparto, or the like can be used for the base paper.

The basis weight of the substrate 2 may be suitably determined. In general, basis weight of 50 to 330 g/m$^2$ is preferable, and 100 to 250 g/m$^2$ is even more preferable.

The ink accepting layer 3 is formed of a pigment, binder, and an auxiliary agent. It is especially preferable that a cationic organic substance such as an ink fixing agent is added to the ink accepting layer 3 as an auxiliary agent, so that a recorded matter is made water resistant.

Examples of the cationic organic substance include low molecular compounds such as primary through tertiary amine compounds, primary through tertiary amine salts, quaternary anmonium salt, oligomers containing primary through tertiary amino groups or primary through tertiary amine salt groups, quaternary ammonium salt group, or polymers containing these groups. More specifically, it is possible to use, for example, diallyldimethylammoniumchloride polymer, diallyl dimethylammoniumchloride-sulfurdioxide copolymer, diallyldimethylammoniumchloride-acrylamide copolymer, diallylmethylammonium salt polymer, diallylamine hydrochloride-sulfurdioxide copolymer, dimethylmethylaminehydrochloride copolymer, polyallylamine, polyethyleneimine, polyethyleneiminequaternaryammonium salt compound, (metha) acrylamidealkylammonium salt polymer, ionen containing quaternaryammonium salt group. Furthermore, instead of the cationic organic substance specified above, inorganic cationic compounds, such as the one disclosed in Patent Laid-Open Publication No. SHO 60-257286, may be added to the ink accepting layer 3.

Moreover, light stabilizers for improving the lightfastness, and fluorescent brightening agents for increasing the brightness, can be used as other auxiliary agents.

In order to ensure high ink absorption and color density, the pigment above may include a porous material having low refractive index, for example, amorphous silica, silica prepared by a precipitation method, gel type silica, alumina (preferably having a boehmite-like structure), silica prepared by a gas phase method, barium sulfate, titanium dioxide, calcium carbonate, kaoline, white earth, magnesium silicate, calcium silicate, or the like.

A water soluble resin having a high film forming property, such as polyvinyl alcohol, polymer latex, gelatin, casein, starch or the like, may be used as the binder above, so that necessary fixing intensity and ink absorption are obtained.

In order to enhance the effect of the present invention, it is preferred that the ink accepting layer 3 contains a zirconium compound. Such zirconium compound should be the same type as the one used in the glossy layer 4. The zirconium compound may be included in the ink accepting layer 3 when forming the glossy layer 4 by having a part of the zirconium compound contained in the coating liquid for forming the glossy layer penetrate through the ink accepting layer 3 before the glossy layer 4 is dried. Alternately, the zirconium compound may be previously contained in the coating liquid for forming the ink accepting layer 3.

The ink accepting layer 3 may be formed by applying to the substrate 2 a coating liquid prepared by dissolving or dispersing in water or adequate solvent the aforementioned composition for forming the ink accepting layer 3, using a coating method freely selected out of roll coating, grade coating, air-knife coating, rod bar coating, photogravure coating, comma coating, dye coating methods, etc.

The basis weight of the ink accepting layer 3 [amount of the coating liquid applied to the ink accepting layer; calculated solid content] may be suitably determined. In general, 5 to 40 g/m$^2$ is preferable, and 10 to 25 g/m$^2$ is even more preferable.

The recording medium 1 according to the present embodiment may be manufactured, for example, in the following manner: A base paper made of a pulp material is provided as a substrate 2. A coating liquid, prepared by dissolving or dispersing in water or other adequate solvents the aforementioned component for forming the ink accepting layer 3, is applied onto the surface of the substrate 2 in an amount (solid content) of preferably 10 to 25 g/m$^2$ using a rod coating method and is subsequently dried, whereby the ink accepting layer 3 is obtained. Subsequently, a coating liquid, prepared by dissolving or dispersing in water or other adequate solvents a zirconium compound and a resin capable of reacting with the zirconium compound and forming a crosslinking structure, is applied onto the surface of the ink accepting layer 3 in an amount (solid content) of preferably 5 to 15 g/m$^2$ using a transcription coating method and thereafter dried at a temperature of preferably 130 to 140° C. and calender processed as necessary, whereby the glossy layer 4 is obtained. The recording medium 1 according to the present embodiment is thus fabricated.

According to the recording method of forming ink images on the recording medium 1 of the present embodiment using a regular recording device, provided is a recorded matter having clear images with high resolution. The recorded matter exhibits outstanding lightfastness.

It will be understood that the recorded matter recording the images has a high quality because the cross section of the recorded matter, which shows the surface damage resistance, is formed almost in the same condition as that prior to the recording, shown in FIG. 1.

Figure 2:
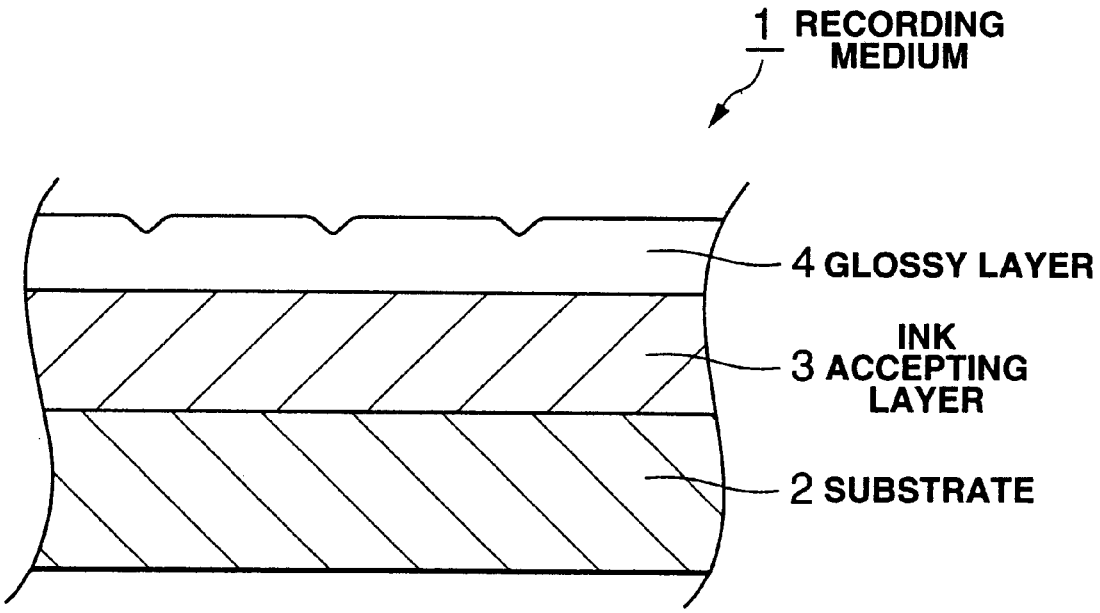
FIG. 2 is a cross section of a recorded matter which is recorded on a conventional recording medium (corresponds to FIG. 1).

On the other hand, if recording is performed using a recording medium having the same structure as the present embodiment except that the glossy layer serving as a surface layer is not hardened by the zirconium compound and the resin capable of reacting with the zirconium compound and forming a crosslinking structure as in the present invention, considerable influence is caused to the surface damage of the recording medium as shown in FIG. 2. The damage in the recording medium is highly conspicuous and the lightfastness of images remain at a low level, such that clear images having high resolution may not be obtained.

The recording medium 1 of the present embodiment may be used as a medium for inkjet recording or bubble jet recording, and especially preferable if used as a medium for inkjet recording. Furthermore, the recording medium 1 according to the present embodiment may be used for recordings performed with a pen or other writing means, or for recordings performed with various types of liquid ink. Moreover, the recording medium 1 of the present embodiment can be used as a recording medium for heat fixing the electronic photo recording toners employed in copying machines, printers or the like, or as a recording medium for labels by including an adhesive layer therein.

Thus, we have so far seen the preferred embodiment of the present invention. It will be understood that the present invention is not limited to the preferred embodiment above, but may be suitably altered within the scope set forth in the subject matter of the invention.

More specifically, instead of using the ink accepting layer 3 in the recording medium 1 according to the above-described embodiment, it is possible to use, for example, a layer provided with air gaps, including inorganic fine powder bonded with an organic cationic polymer (Patent Laid-Open Publication No. HEI 11-58942), or a layer hardened by forming a crosslinking structure within a water soluable resin while the layer is dried at a constant speed, using inorganic fine powder, such resin, and a specific crosslinking agent (Patent Laid-Open Publication No. HEI 11-115308). Otherwise, the ink accepting layer 3 may be replaced with ink accepting layers disclosed in Patent Laid-Open Publications No. HEI 10-81064, No. HEI 10-100397, No. HEI 10-119420, No. HEI 10-119423, No. HEI 10-119424, No. HEI 10-175365, No. HEI 10-193776, No. HEI 10-203006, No. HEI 10-217601, No. HEI 11-20300, No. HEI 11-20306, No. HEI 7-276789, No. HEI 8-174992, etc.

Furthermore, layers other than the ink accepting layer and the glossy layer may be provided if necessary, as long as the glossy layer serving as the surface layer is hardened by a zirconium compound and a resin capable of reacting with the zirconium compound and forming a crosslinking structure.

Now, the present invention is explained in further detail according to the examples and comparative examples set forth below. It should be noted that these examples set no limitation to the present invention. In the following examples, the mark "%" shall mean "percents by weight (calculated solid content)" unless otherwise defined.

EXAMPLES 1 THROUGH 10

Inkjet recording mediums (examples 1 through 10) including layer A (ink absorbing layer) and layer C (glossy layer) shown in Table 1 were fabricated using a coating liquid having the compositions listed below. The recording mediums according to examples 1 through 5, and 7 through 10 were evaluated in an evaluation test (explained below), using inkjet printer "PM-770C" (manufactured by Seiko Epson Corporation). In the evaluation test, the recording medium of example 6 which has the same configuration as the recording medium of example 1 was evaluated as a recorded matter printed in the same manner as example 1, except that inkjet printer "PM-800C" (manufactured by Seiko Epson Corporation) was used for example 6.

Layers Coated with the Coating Liquids were Formed in the Following Manner

Ink Absorbing Layer

Using a bar coater, ink absorbing layer coating liquids A1 through A3 (prepared with a concentration of 20%) were applied in the amount (calculated solid content) shown in Table 1 onto ordinary fine quality paper having a basis weight of 100 g/m$^2$, and the paper was dried for one minute at a temperature of 120° C., whereby an ink absorbing layer was obtained.

Glossy Layer

Using a bar coater, glossy layer coating liquids C1 through C5 (prepared with a concentration of 20%) was applied in the amount (calculated solid content) shown in Table 1 onto a substrate (resin film) not easily attaching to the materials forming the glossy layer, and the side of the substrate having the coating liquid applied thereunto was placed over the ink absorbing layer and dried for one minute at a temperature of 120° C., and the substrate was subsequently peeled away, whereby a glossy layer was obtained.

[Ink Absorbing Layer Coating Liquid]

| | | |
|---|---|---|
| A1 | Silica gel (manufactured by Tokuyama Corp.) | 60% |
| | Polyvinyl alcohol (manufactured by Kuraray Co., Ltd.; saponification rate: 98) | 30% |
| | Cationic organic substance (manufactured by Sumitomo Chemical Co., Ltd.) | 10% |
| A2: | Silica gel (manufactured by Tokuyama Corp.) | 65% |
| | Polyvinyl alcohol (manufactured by Kuraray Co., Ltd.; saponification rate: 98) | 35% |
| A3: | Silica gel (manufactured by Tokuyama Corp.) | 59% |
| | Polyvinyl alcohol (manufactured by Kuraray Co., Ltd.; saponification rate: 98) | 29% |
| | Cationic organic substance (manufactured by Sumitomo Chemical Co., Ltd.) | 9% |
| | Zr $(OH)_4$ (manufactured by Nipponkeikinzoku Co., Ltd.) | 3% |
| | [Glossy layer coating liquid] | |
| C1: | poly2-hydroxyethyl acrylate (manufactured by Kyowa Sangyo) | 17% |
| | Colloidal silica (manufactured by Nissan Chemical Industries, Ltd.) | 80% |
| | Zirconium carbonate ("Bacote 20" manufactured by Nipponkeikinzoku Co., Ltd.) | 3% |
| C2: | Polyvinyl alcohol (manufactured by Kuraray Co., Ltd.; saponification rate: 98) | 17% |
| | Colloidal silica (manufactured by Nissan Chemical Industries, Ltd.) | 80% |
| | Zirconium carbonate ("Bacote 20" manufactured by Nipponkeikinzoku Co., Ltd.) | 3% |
| C3: | Polyvinyl alcohol (manufactured by Kuraray Co., Ltd.; saponification rate: 98) | 17% |
| | Colloidal silica (manufactured by Nissan Chemical Industries, Ltd.) | 80% |
| | Zr$(OH)_4$ (manufactured by Nipponkeikinzoku Co., Ltd.) | 3% |
| C4: | Polyvinyl alcohol (manufactured by Kuraray Co., Ltd.; saponification rate: 88) | 17% |
| | Colloidal silica (manufactured by Nissan Chemical Industries, Ltd.) | 80% |
| | Zirconium carbonate ("Bacote 20" manufactured by Nipponkeikinzoku Co., Ltd.) | 3% |
| C5: | Polyvinyl alcohol (manufactured by Kuraray Co,, Ltd.; saponification rate: 78) | 17% |
| | Colloidal silica (manufactured by Nissan Chemical Industries, Ltd.) | 80% |
| | Zirconium carbonate ("Bacote 20" manufactured by Nipponkeikinzoku Co., Ltd.) | 3% |

COMPARATIVE EXAMPLES 1 THROUGH 8

In the inkjet recording mediums of comparative examples 1 through 8, layer A (ink absorbing layer) was formed in the same manner as in the examples above, except that the following ink absorbing layer coating liquids A4 through A10 were applied in the amount (calculated solid content) shown in Table 2, and the recording mediums were fabricated without including layer C (glossy layer). Furthermore, the recording mediums of comparative examples 1 through 7 were evaluated in the evaluation test explained below, using inkjet printer "PM-770C" (manufactured by Seiko Epson Corporation).

In the evaluation test, the recording medium of comparative example 8, having the same configuration as the recording medium of comparative example 3, was evaluated as a recorded matter printed in the same manner as in comparative example 3, except that inkjet printer "PM-800C" (manufactured by Seiko Epson Corporation) was used for comparative example 8.

[Ink Absorbing Layer Coating Liquid]

| | | |
|---|---|---|
| A4: | Amorphous fine powder silica ("Fine Seal" manufactured by Tokuyama Corp.) | 82% |
| | Polyvinyl alcohol modified by silanol ("R-1130" manutactured by Kuraray Co., Ltd.) | 16% |
| | Zirconium acetate (manufactured by Tokyo Kasei Kogyo Co., Ltd.) | 0.8% |
| | Polyacrylic soda (dispersant manufactured by TOA Gosei) | 1.2% |
| A5: | Amorphous fine powder silica ("Fine Seal" manufactured by Tokuyama Corp.) | 75% |
| | Polyvinyl alcohol modified by silanol ("R-1130" manufactured by Kuraray Co., Ltd.) | 23.6% |
| | Ammonium zirconium carbonate (manufactured by Tokyo Kasei Kogyo Co., Ltd.) | 0.2% |
| | Polyacrylic soda | 1.2% |
| A6: | Amorphous fine powder silica ("Mizukasil" manufactured by Mizusawa Chemical) | 67.5% |
| | Polyvinyl alcohol modified by silanol ("R-1130" manufactured by Kuraray Co., Ltd.) | 30% |
| | Ammonium zirconium carbonate (manufactured by Tokyo Kasei Koqyo Co., Ltd.) | 1% |
| | Polyacrylic soda | 1.5% |
| A7: | Amorphous fine powder silica ("Fine Seal" manufactured by Tokuyama Corp.) | 60% |
| | Sedimentary calcium carbonate ("PZ" manufactured by Shiraishi Kogyo Kaisha, Ltd.) | 26.5% |
| | Polyvinyl alcohol modified by silanol ("R-1130" manufactured by Kuraray Co., Ltd.) | 10% |
| | Zirconium acetate (manufactured by Tokyo Kasei Koqyo Co., Ltd.) | 2% |
| | Polyacrylic soda | 1.5% |
| A8: | Amorphous fine powder silica ("Fine Seal" manufactured by Tokuyama Corp.) | 90% |
| | Polyvinyl alcohol modified by silanol ("R-1130" manufactured by Kuraray Co., Ltd.) | 5% |
| | Ammonium zirconium carbonate (manufactured by Tokyo Kasei Kogyo Co., Ltd.) | 3.5% |
| | Polyacryiic soda | 1.5% |
| A9: | Amorphous fine powder siiica ("Fine Seal" manufactured by | 78.5% |

-continued

| | | |
|---|---|---|
| | Tokuyama Corp.) | |
| | Polyvinyl alcohol modified by silanol ("R-1130" manufactured by Kuraray Co., Ltd.) | 10% |
| | Ammonium zirconium carbonate (manufactured by Tokyo Kasei Kogyo Co., Ltd.) | 10% |
| | Polyacrylic soda | 1.5% |
| A10: | Amorphous fine powder silica ("Fine Seal" manufactured by Tokuyama Corp.) | 82.5% |
| | Polyvinyl alcohol modified by silanol ("R-1130" manufactured by Kuraray Co., Ltd.) | 16.5% |
| | Polyacrylic soda | 1.0% |

[Evaluation of Inkjet Recording Medium]

The zirconium (Zr) distribution, 60-degree mirror surface, lightfastness, waterfastness, ink absorption, notched roller traces and the printing density were evaluated for the respective inkjet recording mediums of examples 1 through 10 and comparative examples 1 through 8 according to the standards specified below. The results are shown in Tables 1 and 2.

(Zirconium Distribution)

The cross sections of inkjet recording mediums cut with a sharp razor were observed in an inorganic property analysis test which was performed using an XMA ("JXA840" manufactured by JEOL Ltd.; and an x-ray micro analyzer manufactured by LINK) attached to a scanning electron microscope. A peak is to be observed if any zirconium is included, therefore it is possible to determine the distribution of zirconium in the layers (either or both of the ink absorbing layer or the glossy layer) to which coating liquids were applied.

(60-degree Mirror Surface [Specular Gloss])

Specular gloss was measured using a glossmeter "Multi-gloss" (manufactured by Minolta Co., Ltd.) pursuant to JIS Z8741-1997.

(Lightfastness)

Using Xe fademeter "Ci35A" (manufactured by Atlas), an acceleration test was performed under the conditions of 340 nm radiant energy of 0.25W/m2, a black panel temperature of 63° C., and relative humidity of 50%. The results of the evaluation were classified according to the conditions specified below, on the basis of irradiation energy values that makes the remaining density 70% for any one of the colors out of C (cyan), M (magenta) and Y (yellow) which have been output under a condition of initial density=1.0 pursuant to ISO10977 ("Photography-processed photographic colour films and paper prints-methods for measuring image stability").

A+: Irradiation at a rate of 55000 klux·h or more

A: Irradiation at a rate of 36000 klux·h or more, less than 55000 klux·h

B: Irradiation at a rate of 18000 klux·h or more, less than 36000 klux·h

C: Irradiation at a rate of 9000 klux·h or more, less than 18000 klux·h

D: Irradiation at a rate less than 9000 klux·h (Waterfastness)

Solid printing portions printed in the respective colors of C (cyan), M (magenta), Y (yellow) and Bk (black) were recorded onto an inkjet recording medium. Using a dropping pipet, a drop of water from the water supply was dropped on the portions printed in the respective colors and dried for one night. The blurring level was visually observed and evaluated according to the following standards:

A: None of the four colors blurred

B: At least one color blurred

C: At least two colors blurred (within the extent allowing utilization)

D: At least three colors blurred (utilization not possible)

(Ink Absorption)

Figure 3:
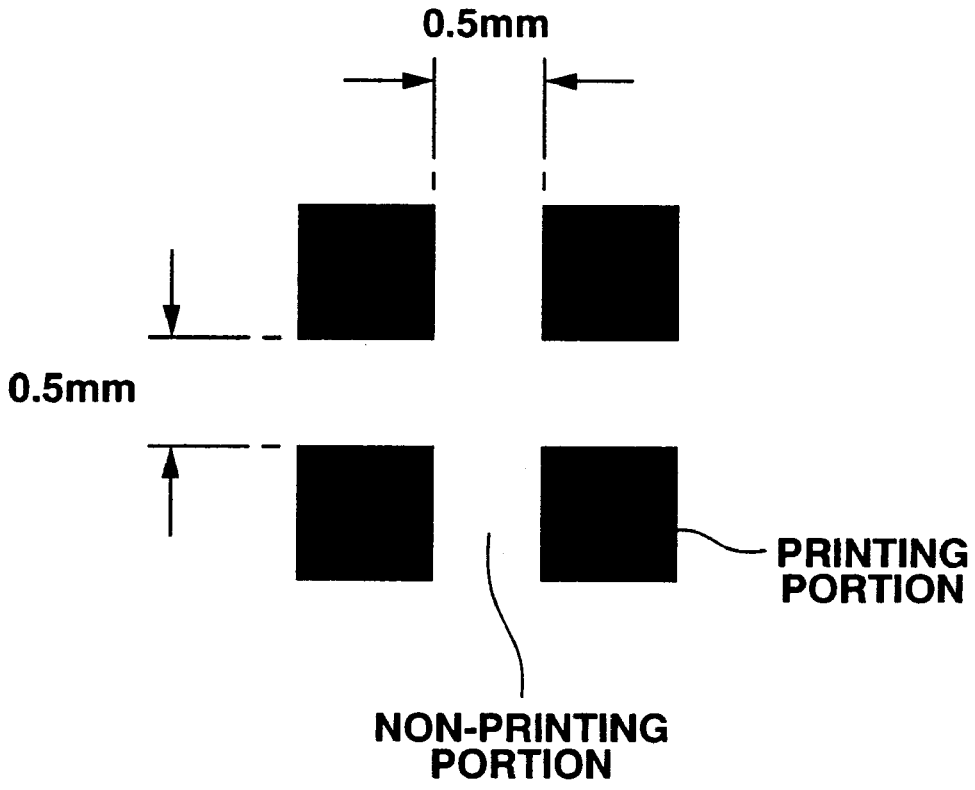
FIG. 3 is a cross-shape reverse printing pattern which is printed for evaluating the ink absorption of a recording medium.

The inkjet recording mediums were printed in the respective colors of C (cyan), M (magenta), Y (yellow), Bk (black), R (red), G (green) and B (blue), so that the printed patch portions would be arranged next to each other to form a cross-shape reverse printing pattern shown in FIG. 3, providing a distance of 0.5 mm between each patch portion. After drying the recording mediums, the distance between the printed patch portions was observed to see if the ink had blurred and the distance between the patch portions was made shorter. An evaluation was performed according to the following standards:

A: The distance measured as 0.5 mm

B: The distance measured as 0.45mm to less than 0.5 mm (limit of utilization)

C: The distance measured as less than 0.45 mm (Notched Roller Traces)

The inkjet recording mediums were formed into A4 size, black-color (Bk) solid printing was performed on the recording mediums, and the notched roller traces (marks) left by the printer were visually observed and evaluated according to the following standards:

A: No traces visible

B: Traces partly visible (limit of utilization)

C: Traces completely visible (Printing Density)

Four-color set solids in the respective colors of C (cyan), M (magenta), Y (yellow) and Bk (black) were printed on inkjet recording medium, and the average value of the reflection density was measured and evaluated according to the standards below. "SPM-50" manufactured by Gretag Machbeth was used for measuring the colors.

A: 1.9 or more

B: 1.8 or more, under 1.9

C: 1.7 or more, under 1.8

D: under 1.7

TABLE 1

| | Composition (Amount Applied: g/m$^2$) | | Zr | 60-degree mirror | | | Ink | Notched roller | Printing |
|---|---|---|---|---|---|---|---|---|---|
| | Layer A | Layer C | Distribution | surface | Lightfastness | Waterfastness | Absorption | Traces | Density |
| Example 1 | A1 (20) | C1 (10) | Both Layers C and A | 42 | A | A | A | A | A |
| Example 2 | A1 (20) | C2 (10) | Both Layers C and A | 45 | A | A | A | A | A |

TABLE 1-continued

| | Composition (Amount Applied: g/m²) | | Zr | 60-degree mirror | | | Ink | Notched roller | Printing |
|---|---|---|---|---|---|---|---|---|---|
| | Layer A | Layer C | Distribution | surface | Lightfastness | Waterfastness | Absorption | Traces | Density |
| Example 3 | A1 (20) | C3 (10) | Layer C | 41 | B | A | A | A | A |
| Example 4 | A1 (10) | C1 (5) | Both Layers C and A | 29 | B | A | B | A | B |
| Example 5 | A1 (25) | C1 (15) | Both Layers C and A | 44 | A | A | A | A | A |
| Example 6* | A1 (20) | C1 (10) | Both Layers C and A | 42 | A+ | A | A | A | A |
| Example 7 | A3 (20) | C3 (10) | Both Layers C and A | 45 | A | A | A | A | A |
| Example 8 | A1 (20) | C4 (10) | Both Layers C and A | 42 | A | A | A | A | A |
| Example 9 | A1 (20) | C5 (10) | Both Layers C and A | 41 | B | A | A | A | A |
| Example 10 | A2 (20) | C1 (10) | Both Layers C and A | 43 | A | C | A | A | B |

(Notes)
*Inkjet printer PM-800C was used for evaluating example 6 having the same configuration as example 1. Inkjet printer PM-770C was used for evaluating the other examples.

TABLE 2

| | Composition (Amount Applied: g/m²) | | Zr | 60-degree mirror | | | Ink | Notched roller | Printing |
|---|---|---|---|---|---|---|---|---|---|
| | Layer A | Layer C | Distribution | surface | Lightfastness | Waterfastness | Absorption | Traces | Density |
| Comparative Example 1 | A4 (5) | | Layer A | 8 | C | B | C | B | C |
| Comparative Example 2 | A5 (10) | | Layer A | 9 | C | B | B | B | C |
| Comparative Example 3 | A6 (20) | | Layer A | 10 | B | B | A | B | B |
| Comparative Example 4 | A7 (5) | | Layer A | 9 | C | C | B | B | D |
| Comparative Example 5 | A8 (2) | | Layer A | 5 | C | C | C | B | D |
| Comparative Example 6 | A9 (5) | | Layer A | 7 | C | B | C | B | C |
| Comparative Example 7 | A10 (5) | | Layer A | 8 | C | C | C | B | C |
| Comparative Example 8* | A6 (20) | | Layer A | 10 | C | B | A | B | C |

(Notes)
*Inkjet printer PM-800C was used for evaluating comparative example 8 having the same configuration as comparative example 3. Inkjet printer PM-770C was used for evalulating the other comparative examples.

The results of the evaluation tests for the respective examples and comparative examples show that, in a recording medium according to the present invention (examples 1 through 10) comprising a substrate, an ink accepting layer and a surface layer, by providing as the surface layer a glossy layer which is hardened by a zirconium compound and a resin capable of reacting with the zirconium compound and forming a crosslinking structure, the recording medium accomplishes outstanding lightfastness of images produced by an inkjet recording, outstanding surface damage resistance of the surface layer of the recording medium owing to the increase in the coated film intensity of the surface layer, clear images with high resolution, favorable waterfastness and color density of images, and favorable glossiness and ink absorption of the recording medium.

Whereas, it is clear that, as compared with the recording medium of the present invention, the recording mediums of comparative examples 1 through 8 which do not include the glossy layer according to the present invention exhibit lower lightfastness of images and surface damage resistance of the recording medium, as well as insufficient waterfastness or color density of images and insufficient glossiness and ink absorption of the recording medium.

Furthermore, according to the present invention, a recording medium (as in examples 1, 2, and examples 4 through 10) containing a zirconium compound in both the glossy layer and the ink absorbing layer can be fabricated by applying onto the ink accepting layer a-glossy layer coating liquid containing a zirconium compound and a resin capable of reacting with the zirconium compound and forming a crosslinking structure. Otherwise, it is possible to fabricate a recording medium (as in examples 2, 3, and examples 6 through 8) containing polyvinyl alcohol having a saponification rate of 88 or more as the resin capable of forming a crosslinking structure, or a recording medium (as in examples 1 through 9) containing a cationic organic substance in the ink absorbing layer. As a result, the recording medium demonstrates outstanding properties in terms of lightfastness, waterfastness of a printed item, glossiness and surface damage resistance (notched roller traces) of the recording medium.

Furthermore, according to the present invention, a higher lightfastness effect is particularly acknowledged when the zirconium compound is distributed in both the glossy layer and the ink absorbing layer (see examples 3 and 7). Furthermore, higher lightfastness effect is particularly acknowledged when polyvinyl alcohol having a saponification rate of 88 or more is used as the aforementioned resin forming the glossy layer (see examples 2, 8 and 9). Furthermore, by including a cationic organic substance in the ink absorbing layer, waterfastness may be particularly obtained without hindering the lightfastness (see examples 1 and 10).

[Evaluation of the Conveyance of the Inkjet Recording Medium]

Furthermore, the conveyance of the respective inkjet recording mediums of examples 1 through 10 and comparative examples 1 through 8 was evaluated according to the following evaluation method. The results are shown in Table 3.

[Conveyance]

Ten thousand sheets of inkjet recording mediums cut into A4 size in the lengthwise direction, used in examples and comparative examples above, were fed into "PM-770C" manufactured by Seiko Epson Corporation. The conveyance of the recording mediums was determined according to the following standards;

◎: Double feed (DF) or non-feed (NF) not generating after feeding 10,000 sheets

○: Double feed (DF) or non-feed (NF) generating at the rate of less than 2% after feeding 10,000 sheets Δ: Double feed (DF) or non-feed (NF) generating at the rate of 2% or more and less than 5% after feeding 10,000 sheets (limit of utilization)

×: Double feed (DF) or non-feed (NF) generating at the rate of more than 5% after feeding 10,000 sheets (utilization not possible)

The term "double feed (DF)" here means all phenomena where more than one sheet of paper is fed instead of only one sheet. The term "non-feed (NF)" means all phenomena where no sheet is fed after the performance of a feeding operation. Both phenomena are due to the dust in the feeding mechanism caused by the generation of paper powders or the falling of powders taking place when the recording medium has low surface intensity.

TABLE 3

| | Conveyance | | Conveyance |
|---|---|---|---|
| Example 1 | ◎ | Comparative example 1 | ○ |
| Example 2 | ◎ | Comparative Example 2 | Δ |
| Example 3 | ◎ | Comparative Example 3 | Δ |
| Example 4 | ◎ | Comparative Example 4 | ○ |
| Example 5 | ◎ | Comparative Example 5 | ○ |
| Example 6 | ◎ | Comparative Example 6 | ○ |
| Example 7 | ◎ | Comparative Example 7 | Δ |
| Example 8 | ◎ | Comparative Example 8 | X |

TABLE 3-continued

| | Conveyance | Conveyance |
|---|---|---|
| Example 9 | ◎ | |
| Example 10 | ◎ | |

The results in Table 3 show that the present invention ensures high surface resistance of the recording medium, whereby the generation of paper powder or the falling of powder is prevented and favorable conveyance is obtained.

According to the present invention, provided is a recording medium which enables outstanding lightfastness of images, outstanding glossiness, surface damage resistance and conveyance of the recording medium, as well as improved waterfastness of images, and improved printing density and ink absorption of the recording medium. Furthermore, according to the present invention, provided is a manufacturing method and a recording method of a recording medium which enables outstanding lightfastness of images, outstanding glossiness, surface damage resistance and conveyance of the recording medium, as well as improved waterfastness of images, improved printing density and ink absorption of the recording medium.

Moreover, according to the present invention, provided is a higher quality recorded matter due to the enhanced lightfastness of images, as well as higher waterfastness and printing density.

What is claimed is:

1. A recording medium comprising:

a substrate;

an ink accepting layer provided on said substrate; and a glossy layer serving as a surface layer, provided on said ink accepting layer;

wherein said glossy layer comprises a zirconium compound and a resin capable of reacting with said zirconium compound and forming a crosslinking structure.

2. A recording medium according to claim 1, wherein said glossy layer is formed by coating the ink accepting layer with a coating liquid containing the zirconium compound and the resin capable of reacting with the zirconium compound and forming a crosslinking structure.

3. A recording medium according to claim 1, wherein said resin capable of forming a crosslinking structure is a resin having a hydroxyl group.

4. A recording medium according to claim 3, wherein said resin having a hydroxyl group is a polyvinyl alcohol having a, saponification rate of 80 or more.

5. A recording medium according to claim 1, wherein said ink accepting layer contains a cationic organic substance.

6. A recording medium according to claim 1, wherein said ink accepting layer contains a zirconium compound.

7. A recording medium according to claim 1, wherein said glossy layer is formed by a cast coating method or a transcription coating method.

8. A recording medium according to claim 1, wherein the 60-degree mirror surface defined by JIS Z8741 is measured as 20% or more for said glossy layer.

9. A recording medium according to claim 1, wherein said recording medium is an inkjet recording medium.

10. A method for manufacturing the recording medium according to claim 1,- wherein a coating liquid containing a zirconium compound and a resin capable of reacting with the zirconium compound and forming a crosslinking structure is applied to an ink accepting layer, and a glossy layer is thereby formed.

11. A method for manufacturing the recording medium according to claim 10, wherein said glossy layer is formed by a cast coating method or a transcription coating method.12. A method for recording ink images using the recording medium according to claim 1.

13. A recorded matter having ink images formed onto the recording medium according to claim 1.

* * * * *

UNITED STATES PATENT AND TRADEMARK OFFICE

CERTIFICATE OF CORRECTION

PATENT NO. : 6,517,929 B1 
DATED : February 11, 2003
INVENTOR(S) : Masaya Shibatani et al.

It is certified that error appears in the above-identified patent and that said Letters Patent is hereby corrected as shown below:

Title page,
Item [*] Notice, "0" should read -- 96 --.

Signed and Sealed this

Twenty-eighth Day of June, 2005

JON W. DUDAS
*Director of the United States Patent and Trademark Office*